US010314131B1

(12) United States Patent
Chen et al.

(10) Patent No.: US 10,314,131 B1
(45) Date of Patent: Jun. 4, 2019

(54) LED DRIVER WITH BRIGHTNESS CONTROL AND DRIVING METHOD THEREOF

(71) Applicant: ANPEC ELECTRONICS CORPORATION, Hsinchu (TW)

(72) Inventors: Wen-Yen Chen, Hsinchu (TW); Ming-Hung Chang, Hsinchu County (TW)

(73) Assignee: ANPEC ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 16/186,432

(22) Filed: Nov. 9, 2018

(30) Foreign Application Priority Data

Sep. 5, 2018 (TW) ..... 107131146 A

(51) Int. Cl.
*H05B 33/08* (2006.01)

(52) U.S. Cl.
CPC ..... *H05B 33/0851* (2013.01); *H05B 33/0824* (2013.01)

(58) Field of Classification Search
None
See application file for complete search history.

(56) References Cited

U.S. PATENT DOCUMENTS

| | | | | |
|---|---|---|---|---|
| 7,928,671 | B1 * | 4/2011 | Wong | H05B 33/0845 315/291 |
| 2008/0231209 | A1 * | 9/2008 | Shiwaya | H05B 33/0827 315/291 |
| 2010/0164396 | A1 * | 7/2010 | Lindeberg | H05B 33/0818 315/291 |
| 2013/0147374 | A1 * | 6/2013 | Kim | H05B 33/0824 315/186 |
| 2016/0095181 | A1 * | 3/2016 | Schiappelli | H05B 33/0815 315/210 |

* cited by examiner

*Primary Examiner* — Jany Richardson
(74) *Attorney, Agent, or Firm* — Li & Cai Intellectual Property (USA) Office

(57) ABSTRACT

The present disclosure provides an LED driver with brightness control and a driving method thereof, which adjust a first rate of a first current mirror, a second rate of a second current mirror, and a reference current of a current source according to the brightness to be presented (related to image brightness information) to adaptively adjust an LED current flowing through an LED string, thereby reducing the loss of the LED current during operation over an operating current range. Besides, the LED driver with brightness control and the driving method thereof do not require that an operator adjusts the variation of the LED current in different operating current ranges in advance, thereby reducing the test time and cost and avoiding the operator from deciding a wrong adjustment amount.

11 Claims, 9 Drawing Sheets

LED DRIVER WITH BRIGHTNESS CONTROL AND DRIVING METHOD THEREOF

CROSS-REFERENCE TO RELATED PATENT APPLICATION

This application claims the benefit of priority to Taiwan Patent Application No. 107131146, filed on Sep. 5, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure provides a light-emitting diode (LED) driver and a driving method thereof, and in particular, to an LED driver with brightness control and a driving method thereof.

BACKGROUND OF THE DISCLOSURE

LEDs have been massively produced at present, and most of the LEDs are used for lighting and display. A plurality of LEDs can be connected in series to form one or more LED strings, and an LED driver drives the LED string to emit light. A conventional LED driver has varied structures, one of which is shown in FIG. 1. An LED driver 10 is coupled to an LED string 50, and drives the LED string 50 according to image brightness information Sbr. The LED driver 10 may control an LED current IL flowing through the LED string 50 according to different image brightness information Sbr (that is, different image brightness information Sbr corresponds to a different LED current IL), so as to control the brightness of the LED string 50. Because the brightness is controlled within a relatively wide operating current range, the image brightness information Sbr needs to be programmed also within a relatively wide range.

As shown in FIG. 1, the LED driver 10 includes an LED controller 11, a current source 13, a first current mirror 15, a second current mirror 17, and a drive transistor 19. The LED controller 11 receives the image brightness information Sbr, generates a digital code signal Code according to the image brightness information Sbr, and transmits the digital code signal Code to the current source 13, to adjust a reference current Iref flowing through the current source 13. Further, if the digital code signal Code is 8-bit data, the LED controller 11 converts the image brightness information Sbr into an 8-bit digital code signal Code, to adjust the reference current Iref flowing through the current source 13.

The first current mirror 15 generates a first current I1 according to the reference current Iref and a first rate K1 of the first current mirror 15. Subsequently, the second current mirror 17 generates the LED current IL flowing through the LED string 50 according to the first current I1 and a second rate K2 of the second current mirror 17. In addition, the LED controller 11 generates a pulse-width modulation (PWM) signal according to the image brightness information Sbr, to turn on/off the drive transistor 19. In this way, the LED string 50 is driven, and the brightness of the LED string 50 is controlled according to the LED current IL. It should be noted that, the LED current IL is equal to a product obtained by multiplying the reference current Iref, the first rate K1, and the second rate K2 together, where the first rate K1 multiplied by the second rate K2 is a constant.

Therefore, the first rate K1 and the second rate K2 are nonadjustable constants conventionally, and the brightness (corresponding to the LED current IL) is controlled within a relatively wide operating current range (for example, from a small current 20 mA to a large current 200 mA). Therefore, the image brightness information Sbr needs to be programmed also within a relatively wide range. However, if running within a relatively wide operating current range, the conventional LED driver 10 is unable to correctly maintain the LED current IL in a preset variation range.

FIG. 2 simulates a variation of the LED current IL in the case where the conventional LED driver 10 runs within a relatively wide operating current range (that is, from a small current 20 mA to a large current 200 mA). As shown in FIG. 2, the curves CV1 and CV2 separately show a result obtained through a Monte Carlo method performed for different numbers of times. In the operating current range from the small current 20 mA to the large current 200 mA, the variation of the LED current IL gradually decreases. Therefore, if the preset variation range is set from −2% to +2%, the variations shown by the curves CV1 and CV2 cannot be maintained in the preset variation range all the time. A conventional solution is to correct the variation of the LED current IL in sections according to the simulation diagram of FIG. 2. As shown in FIG. 2, an operator divides the whole operating current range (that is, from 20 mA to 200 mA) into four sections A, B, C, and D according to the result shown by the actual simulation diagram, and then adjusts the variation in each section of A to D, such that the adjusted variation is maintained in the preset variation range. However, the conventional solution increases the test time and cost, and the operator cannot correctly decide an adjustment amount for each section, causing an unsatisfactory effect after the adjustment.

SUMMARY OF THE DISCLOSURE

In order to reduce the test time and cost and avoid the operator from deciding a wrong adjustment amount, an objective of the present disclosure is to provide an LED driver with brightness control and a driving method thereof, so as to solve the foregoing problems.

An embodiment of the present disclosure provides an LED driver with brightness control, which is used to reduce the loss of an LED current flowing through an LED string in an operating current range. The LED driver includes a first current mirror, a second current mirror, and an LED controller. The first current mirror is coupled to a current source, and generates a first current according to a reference current generated by the current source, where the first current is the reference current multiplied by a first rate. The second current mirror is coupled to the first current mirror via a first transistor switch, is coupled to the LED string via a drive transistor, and generates an LED current flowing through the LED string according to the first current, where the LED current is the first current multiplied by a second rate. The LED controller is coupled to the current source, the first current mirror, and the second current mirror. The LED controller receives image brightness information; generates a first parameter, a second parameter, a digital signal, a control signal, and a PWM signal according to the image brightness information; and drives the LED string according to the PWM signal and the control signal. The first current mirror adjusts the first rate according to the first parameter. The second current mirror adjusts the second rate according to the second parameter. The LED controller adjusts the reference current according to the digital signal multiplied by a third rate, where a product obtained by multiplying the first rate, the second rate, and the third rate together is a fixed value.

An embodiment of the present disclosure provides an LED driving method with brightness control, which is applicable to an LED driver. The LED driver is coupled to an LED string, and is used to reduce the loss of an LED current flowing through the LED string in an operating current range. The LED driving method includes the following steps: step (A): receiving image brightness information, and generating a first parameter, a second parameter, a digital signal, and a PWM signal according to the image brightness information; step (B): adjusting a first rate according to the first parameter, adjusting a second rate according to the second parameter, and adjusting a reference current according to the digital signal multiplied by a third rate, where the reference current is generated by a current source, and a product obtained by multiplying the first rate, the second rate, and the third rate together is a fixed value; step (C): adjusting the reference current according to the first rate to generate a first current, and adjusting the first current according to the second rate to generate an LED current flowing through the LED string, where the first current is the reference current multiplied by the first rate, and the LED current is the first current multiplied by the second rate; and step (D): driving the LED string according to the PWM signal and the control signal.

To sum up, the LED driver with brightness control and the driving method thereof in the present disclosure adjust a first rate of a first current mirror, a second rate of a second current mirror, and a reference current of a current source according to the brightness to be presented (related to image brightness information) to adaptively adjust an LED current flowing through an LED string, thereby reducing the loss of the LED current during operation over an operating current range. Besides, the LED driver with brightness control and the driving method thereof in the present disclosure do not require that the operator adjusts the variation of the LED current in different operating current ranges in advance, thereby reducing the test time and cost and avoiding the operator from deciding a wrong adjustment amount.

In order to further understand features and technical content of the present disclosure, reference is made to the following detailed descriptions and drawings related to the present disclosure. However, the accompanying drawings are merely used to describe the present disclosure, but not intended to limit the scope of the present disclosure.

DETAILED DESCRIPTION OF THE EXEMPLARY EMBODIMENTS

Figure 1:
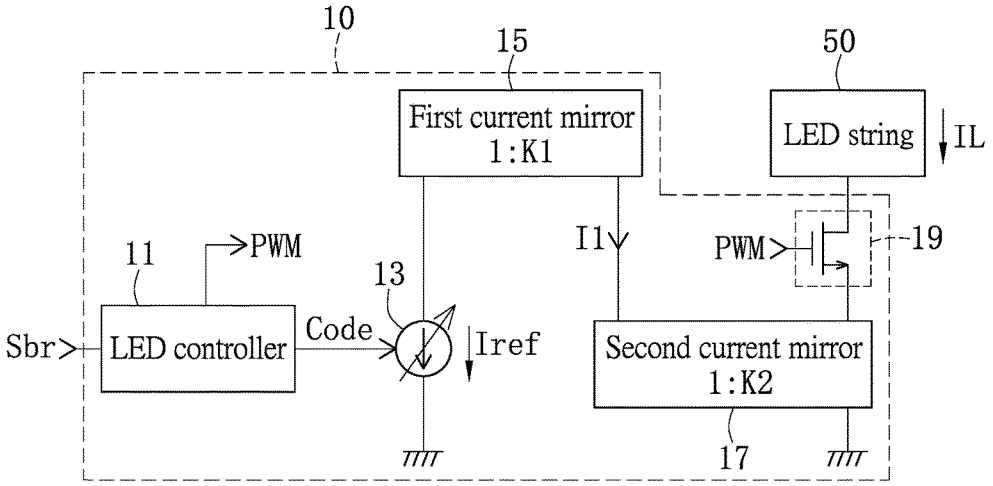
FIG. 1 RELATED ART
FIG. 1 is a schematic diagram of a conventional LED driver.
Figure 2:
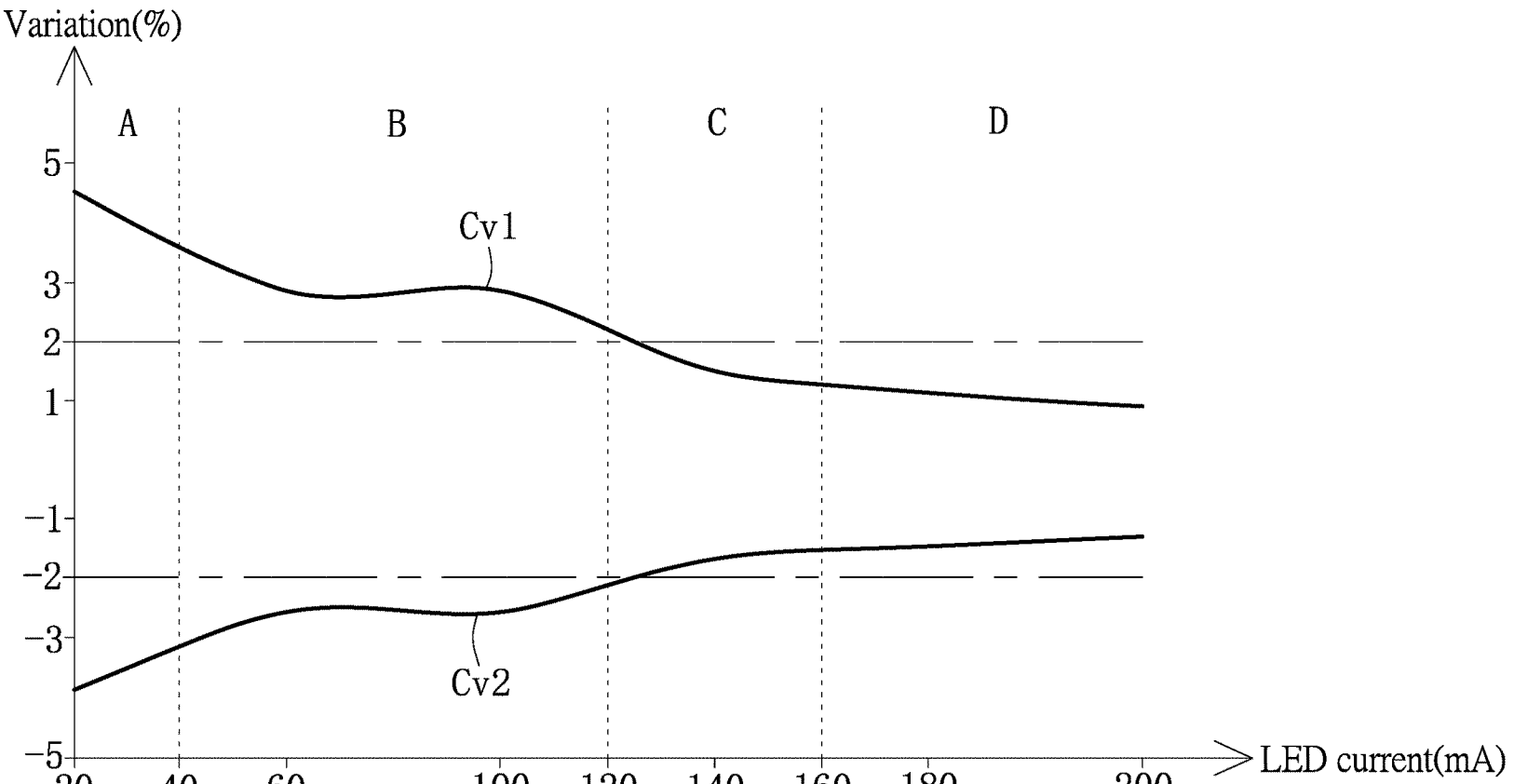
FIG. 2 RELATED ART
FIG. 2 is a diagram showing a conventional relationship between an LED current and a variation during operation over an operating current range.

In the following, the present disclosure will be described in detail by way of illustration of various exemplary embodiments of the present disclosure with reference to the drawings. However, the concept of the present inventive may be embodied in many different forms and should not be construed as being limited to the illustrative embodiments set forth herein. In addition, the same reference numerals in the drawings may be used to indicate similar elements.

An LED driver with brightness control and a driving method thereof provided by the embodiments of the present disclosure adjust an LED current flowing through an LED string according to the brightness to be presented (related to image brightness information) and a relationship between a first rate of a first current mirror, a second rate of a second current mirror, and a third rate for adjusting a reference current (the relationship indicates that a product obtained by multiplying the first rate, the second rate, and the third rate together is a fixed value). Furthermore, as the LED current gradually increases from a small current to a large current (that is, the reference current gradually increases (related to the image brightness information)), the first rate gradually decreases while the second rate gradually increases; or the first rate is fixed, the third rate gradually decreases while the second rate gradually increases, to adaptively reduce the loss of the LED current during operation over an operating current range. In addition, the LED driver and the driving method thereof can further divide the operating current range into multiple operating sections and adjust a variation of the LED current in sections, thus reducing circuit computation. Therefore, the LED driver and the driving method thereof in the present disclosure do not require that an operator adjusts the variation of the LED current in different operating current ranges in advance, thereby reducing the test time and cost and avoiding the operator from deciding a wrong adjustment amount. The following further describes the LED driver with brightness control and the driving method thereof disclosed by the present disclosure.

Figure 3A:
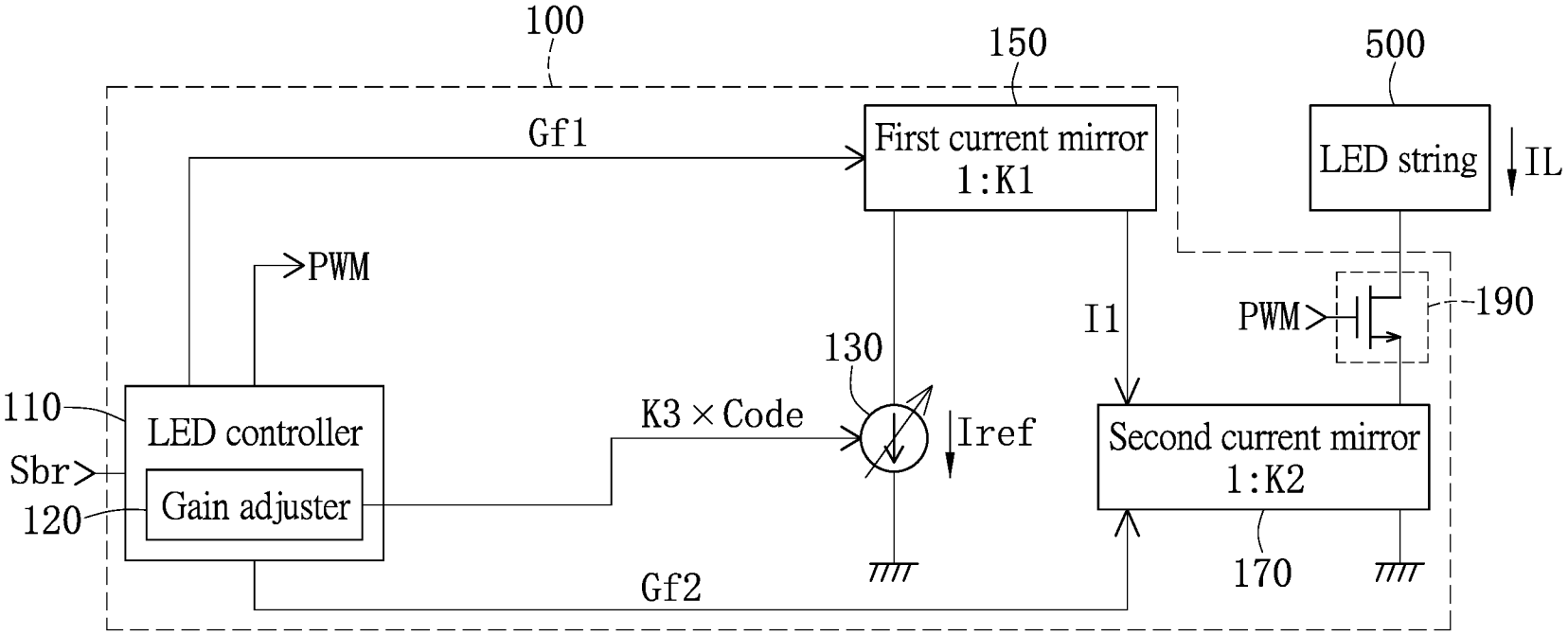
FIG. 3A is a schematic diagram of an LED driver in an embodiment of the present disclosure.

First, reference is made to FIG. 3A, which is a schematic diagram of an LED driver according to an embodiment of the present disclosure. As shown in FIG. 3A, the LED driver 100 is coupled to an LED string 500 and drives the LED string 500 according to image brightness information Sbr, to reduce the loss of an LED current IL flowing through the LED string 500 in an operating current range. The LED driver 100 can control the LED current IL according to different image brightness information Sbr (that is, different image brightness information Sbr corresponds to a different LED current IL), to control the brightness of the LED string 500.

The LED driver 100 includes an LED controller 110, a current source 130, a first current mirror 150, a second current mirror 170, and a drive transistor 190. The LED controller 110 is coupled to the current source 130, the first current mirror 150, and the second current mirror 170. The first current mirror 150 is coupled to the current source 130, and generates a first current I1 according to a reference current Iref generated by the current source 130. Based on an internal element structure of the first current mirror 150, a proportional relationship is formed between the reference current Iref and the first current I1, and the first current I1 is the reference current Iref multiplied by a first rate K1.

The second current mirror 170 is directly coupled to the first current mirror 150, and coupled to the LED string 500 via the drive transistor 190. In this embodiment, the drive transistor 190 may be a P-type transistor, N-type transistor, or another transistor with a switch function, but the present disclosure is not limited thereto. The second current mirror 170 generates the LED current IL flowing through the LED string 500 according to the received first current I1. Based on an internal element structure of the second current mirror 170, a proportional relationship is formed between the LED current IL and the first current I1, and the LED current IL is the first current I1 multiplied by a second rate K2.

Therefore, a relationship between the LED current IL and the reference current Iref is: an LED peak current IL=the reference current Iref×the first rate K1×the second rate K2. The internal element structure of the first current mirror 150 which implements that the first current I1 is the reference current Iref multiplied by the first rate K1, and the internal element structure of the second current mirror 170 which implements that the LED current IL is the first current I1 multiplied by the second rate K2 are known by persons with ordinary skill in the art, so the details are not described herein again.

The LED controller 110 is coupled to the current source 130, the first current mirror 150, and the second current mirror 170. The LED controller 110 receives image brightness information Sbr, and generates a first parameter Gf1, a second parameter Gf2, a digital signal Code, and a PWM signal according to the image brightness information Sbr. The LED controller 110 drives the LED string 500 according to the PWM signal. In this embodiment, when the LED controller 110 generates a high-level PWM signal in a duty cycle, the LED controller 110 turns on PWM for a transistor to drive the LED string 500. On the contrary, when the LED controller 110 generates a low-level PWM signal, the LED controller 110 turns off PWM for the transistor to stop driving the LED string 500. Therefore, the LED controller 110 may turn on/off the drive transistor 190 according to the PWM signal, to further drive the LED string 500. In addition, the LED controller 110 transmits the first current I1 to the second current mirror 170, to provide the LED current IL flowing through the LED string 500.

The LED controller 110 receives the image brightness information Sbr; generates a digital signal Code, for example, a 4-bit or 8-bit digital signal Code, according to the image brightness information Sbr; and then adjusts the digital signal Code to obtain the digital signal Code multiplied by a third rate K3 (that is, K3×Code). Furthermore, the LED controller 110 has a gain adjuster 120. The gain adjuster 120 receives and adjusts the digital signal Code to generate the digital signal Code multiplied by the third rate K3. Referring to FIG. 3A again, the first current mirror 150 adjusts the first rate K1 of the first current mirror 150 according to the first parameter Gf1, and the second current mirror 170 adjusts the second rate K2 of the second current mirror 170 according to the second parameter Gf2. The LED controller 110 adjusts the reference current Iref of the current source 130 according to the digital signal Code multiplied by the third rate K3.

It should be noted that, the product obtained by multiplying the first rate K1, the second rate K2 and the third rate K3 together is a fixed value. For example, based on a particular piece of image brightness information Sbr, the first rate K1 is 4, the second rate K2 is 500, and the third rate K3 is 1. However, based on another piece of image brightness information Sbr, the first rate K1 is 4, the second rate K2 is 250, and the third rate K3 is 2. Therefore, during design of the first parameter Gf1, the second parameter Gf2, and the third rate K3, the second parameter Gf2 needs to be equal to the first parameter Gf1 multiplied by the third rate K3 (that is, Gf2=Gf1×K3), such that the LED current IL generated by the second current mirror 170 and flowing through the LED string 500 can be maintained in a preset variation range (for example, from −2% to +2%).

Preferably, in the operating current range of the LED driver 100, when the LED current IL gradually increases from a small current to a large current (that is, when the value of the image brightness information Sbr gradually increases or the brightness is gradually raised), the first current mirror 150 reduces the first rate K1 according to the decreasing first parameter Gf1, while the second current mirror 170 raises the second rate K2 according to the decreasing second parameter Gf2. In this embodiment, the reduced first rate K1 is denoted by K1×Gf1. The raised second rate K2 is denoted by K2/Gf2.

Figure 3B:
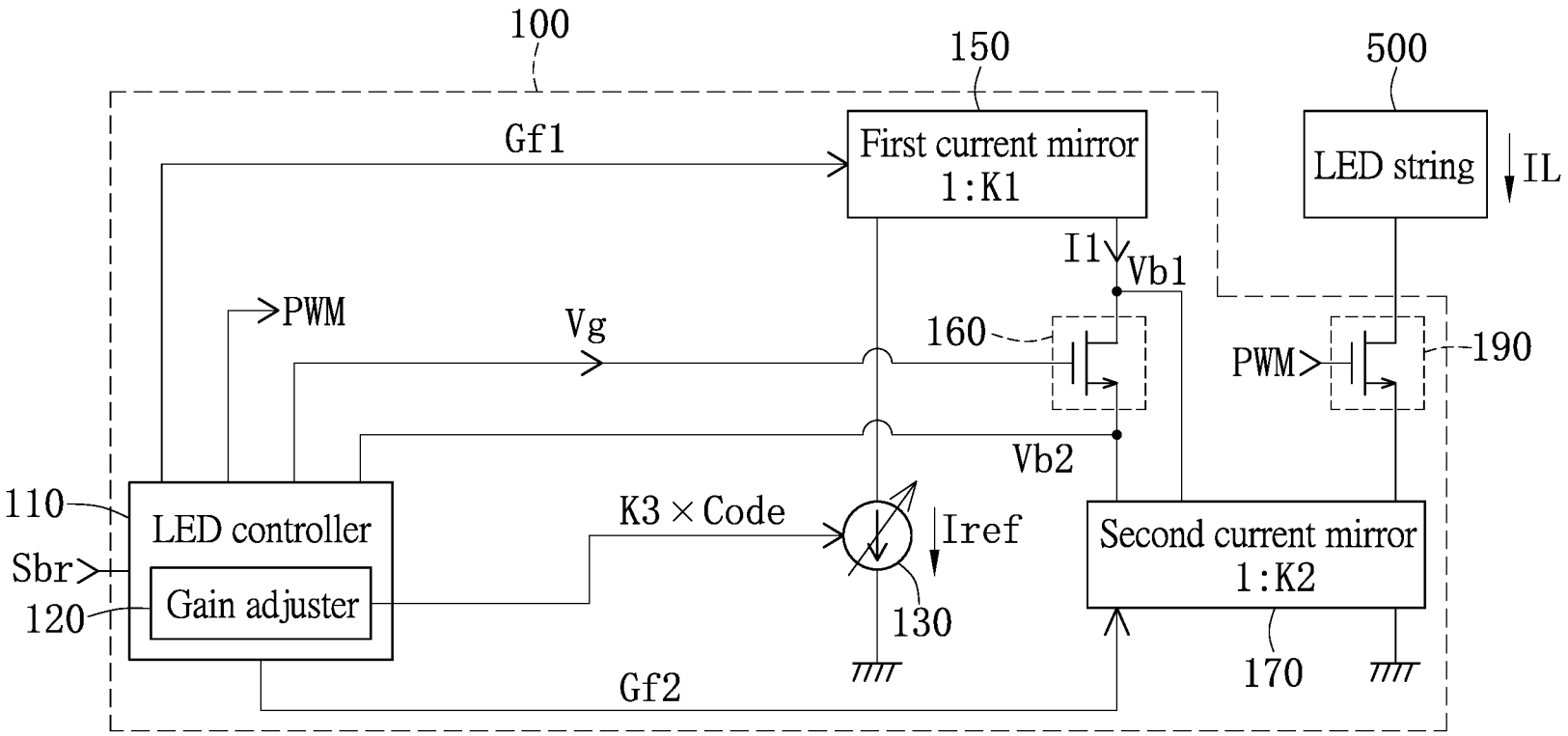
FIG. 3B is a schematic diagram of an LED driver in another embodiment of the present disclosure.

Reference is made to FIG. 3B, which is a schematic diagram of an LED driver in another embodiment of the present disclosure. The part same as that in FIG. 3A is not described herein again, and the following merely describes different features shown in FIG. 3B. Compared with that shown in FIG. 3A, the LED driver 100 in FIG. 3B further includes a first transistor 160. The second current mirror 170 is coupled to the first current mirror 150 via the first transistor 160. The first transistor 160 may be a P-type transistor, a N-type transistor, or another transistor with a switch function, but the present disclosure is not limited thereto.

A gate of the first transistor 160 is connected to the LED controller 110, a drain of the first transistor 160 is connected to a source of the first current mirror 150 and a gate of the second current mirror 170, and a source of the first transistor 160 is connected to the LED controller 110 and a drain of the second current mirror 170. The LED controller 110 generates a control signal Vg to drive the first transistor 160, and then feeds back a source voltage Vb2 of the first transistor 160 to the LED controller 110, to control a drain voltage Vb2 of the second current mirror 170.

In the operating current range of the LED driver 100, when the LED current IL gradually increases from a small current to a large current (that is, when the value of the image brightness information Sbr gradually increases or the brightness is gradually raised), the control signal Vg drives the first transistor 160, to gradually increase the drain voltage Vb2 of the second current mirror 170, such that the LED current IL generated by the second current mirror 170 and flowing through the LED string 500 can be maintained in a preset variation range (for example, from −2% to +2%).

Figure 4A:
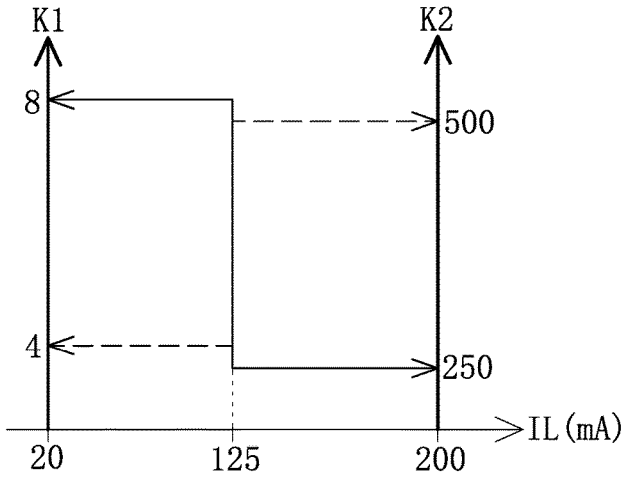
FIG. 4A is a diagram showing a relationship between a first rate, a second rate, and an LED current in an embodiment of the present disclosure.
Figure 4B:
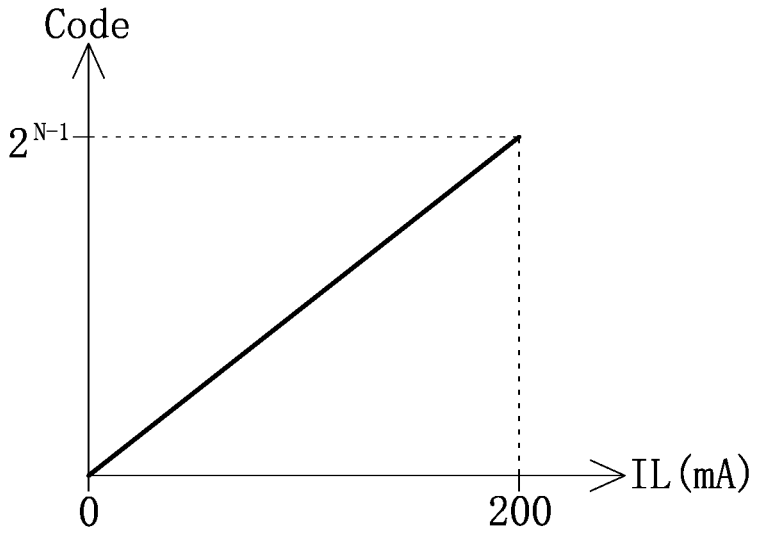
FIG. 4B is a diagram showing a relationship between a digital signal and an LED current in an embodiment of the present disclosure.
Figure 4C:
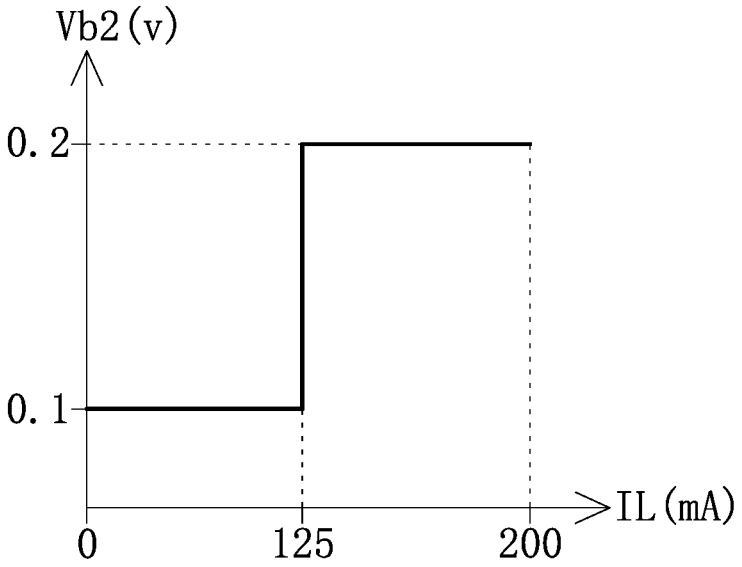
FIG. 4C is a diagram showing a relationship between a drain voltage of a second current mirror and an LED current in an embodiment of the present disclosure, the drain voltage being controlled according to a control signal.

In other embodiments, the image brightness information Sbr may be divided into several numeric intervals. The LED controller 110 decreases the second rate K2 and increases the first rate K1 sequentially according to the magnitude of numeric values in these numeric intervals. The numeric values in these numeric intervals are in direct proportion to the values of the LED current IL. For example, as shown in FIG. 4A to FIG. 4C, the image brightness information Sbr is divided into two numeric intervals which are a first numeric interval (correspondingly, 20 mA≤LED current IL≤125 mA) and a second numeric interval (correspondingly, LED current IL>125 mA). As shown in FIG. 4A, the first rate K1 and the second rate K2 corresponding to the first numeric interval are respectively 8 and 250, and the first rate K1 and the second rate K2 corresponding to the second numeric interval are respectively 4 and 500. As shown in FIG. 4B, the digital signal Code and the LED current IL (related to the image brightness information Sbr) meet a linear relationship. As shown in FIG. 4C, the drain voltage Vb2 of the second current mirror 170 corresponding to the first numeric interval is 0.1V, and the drain voltage Vb2 of the second current mirror 170 corresponding to the second numeric interval is 0.2V.

Therefore, when receiving image brightness information Sbr representing the first numeric interval, the LED controller 110 matches the first rate K1 and the second rate K2 with 4 and 500 respectively according to the relationship diagram of FIG. 4A, matches the image brightness information Sbr with a particular digital signal Code according to the relationship diagram of FIG. 4B, and matches the drain voltage Vb2 of the second current mirror 170 with 0.1V according to the relationship diagram of FIG. 4C. The LED controller 110 then generates an LED current IL according to the foregoing numeric values to drive the LED string 500. Similarly, when receiving image brightness information Sbr representing the second numeric interval, the LED controller 110 finds the matched values in the same manner, and generates the LED current IL to drive the LED string 500.

It can be known from the above that, because the image brightness information Sbr is divided into two numeric intervals, the first rate K1, the second rate K2, and the third rate K3 can be adjusted only twice. Thus, the LED controller 110 does not need to adjust the first parameter Gf1, the second parameter Gf2, and the third rate K3 at any time as the image brightness information Sbr is changed, thereby reducing circuit computation. It should be noted that, more numeric intervals of the image brightness information Sbr indicate a smaller variation of the LED current IL generated by the LED controller 110, and a smoother LED current IL in the whole operating current range.

Figure 5:
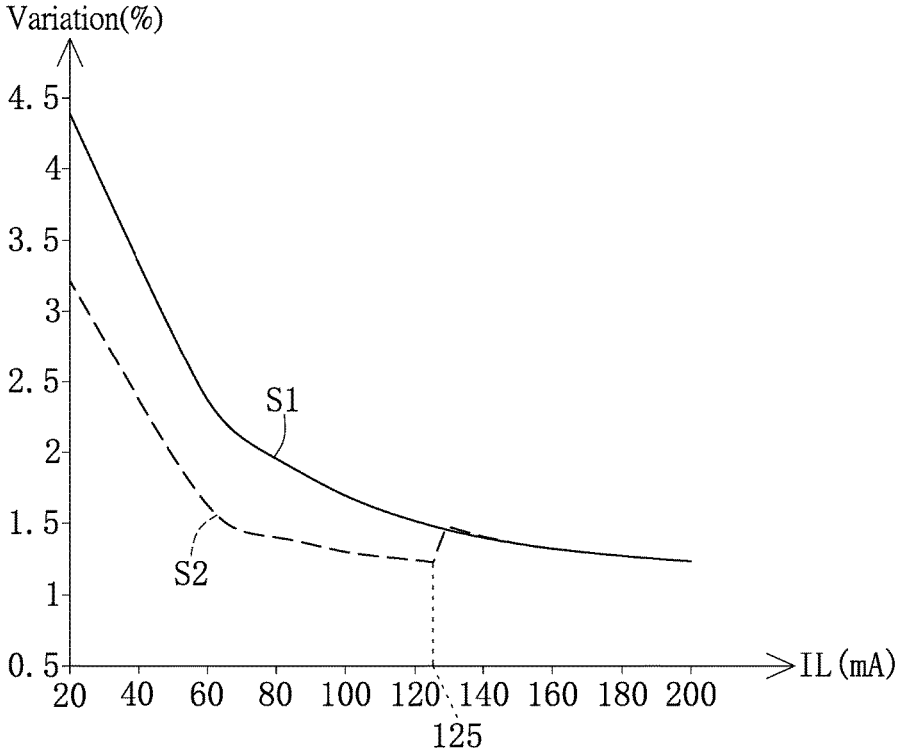
FIG. 5 RELATED ART
FIG. 5 is a diagram showing a relationship between a conventional LED driver and an LED driver of the present disclosure.

Afterwards, reference is made to FIG. 5, which is a diagram showing a relationship between a conventional LED driver and an LED driver of the present disclosure. The curve S1 (a solid line) simulates a variation of an LED current IL in the case where the conventional LED driver 10 runs in an operating current range of 20 mA to 200 mA. In the curve S1, the first rate K1 is 4, the second rate K2 is 500, and the third rate K3 is 1. The curve S2 (a dotted line) simulates a variation of an LED current IL in the case where the LED driver 100 runs in an operating current range of 20 mA to 200 mA. In the curve S2, the image brightness information Sbr is divided into two numeric intervals, as shown in FIG. 4A to FIG. 4C. The first rate K1, the second rate K2 and the third rate K3 that correspond to the first numeric value is 8, 250, and 1 respectively. The first rate K1, the second rate K2 and the third rate K3 that correspond to the second numeric value is 4, 500, and 1 respectively.

Therefore, as shown in FIG. 5, in the operating current range of 20 mA<IL≤125 mA, a variation (related to the LED driver 100 of the present disclosure) shown by the curve S2 is lower than that (related to the conventional LED driver 10) shown by the curve S1. In the operating current range of IL>125 mA, a variation shown by the curve S2 is equal to that shown by the curve S1. Thus, compared with the conventional LED driver 10, the LED driver 100 of the present disclosure can adaptively reduce the loss of an LED current IL in an operating current range.

Figure 6:
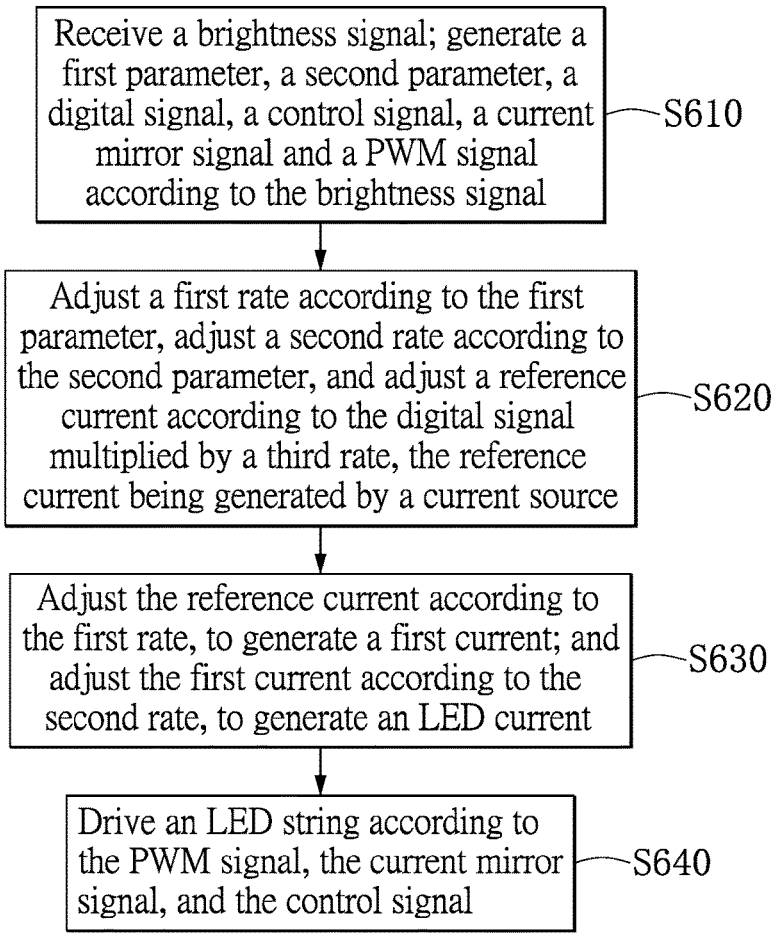
FIG. 6 is a flowchart of an LED driving method according to an embodiment of the present disclosure.

From the foregoing embodiment, the present disclosure concludes an LED driving method, which is applicable to the LED driver 100 with brightness control described in the foregoing embodiment. Reference is made to FIG. 3B and FIG. 6 together. First, the LED driver 100 receives image brightness information Sbr; generates a first parameter Gf1, a second parameter Gf2, a digital signal Code, a control signal Vg, a current mirror signal (including the source voltage Vb2 of the first transistor 160 and the drain voltage Vb2 of the second current mirror 170 that are described above), and a PWM signal according to the image brightness information Sbr (step S610).

In other embodiments, the image brightness information Sbr may be divided into several numeric intervals, and numeric values in these numeric intervals are in direct proportion to the values of the LED current IL. In this step S610, the LED driver 100 may decrease the first parameter Gf1 sequentially according to the magnitude of the numeric values in these numeric intervals, to reduce a first rate K1; and decrease the second parameter Gf2 sequentially to raise a second rate K2.

Subsequently, the LED driver 100 adjusts the first rate K1 according to the first parameter Gf1, adjusts the second rate K2 according to the second parameter Gf2, and adjusts a reference current Iref according to the digital signal Code multiplied by a third rate K3, the reference current Iref being generated by a current source (step S620). A product obtained by multiplying the first rate K1, the second rate K2, and the third rate K3 together is a fixed value. Furthermore, the LED driver 100 reduces the first rate K1 according to the decreasing first parameter Gf1, while raises the second rate K2 according to the decreasing second parameter Gf2.

Then, the LED driver 100 adjusts the reference current Iref according to the first rate K1, to generate a first current I1; and adjusts the first current I1 according to the second rate K2, to generate an LED current IL flowing through the LED string 500 (step S630). The first current I1 is the reference current Iref multiplied by the first rate K1, and the LED current IL is the first current I1 multiplied by the second rate K2.

Finally, the LED driver 100 drives the LED string 500 according to the PWM signal, the control signal Vg, and the current mirror signal (including the source voltage Vb2 of the first transistor 160 and the drain voltage Vb2 of the second current mirror 170 that are described above) (step S640). Implementations of steps S610 to S640 have been roughly explained in the foregoing embodiment, so details are not described herein again.

Figure 7:
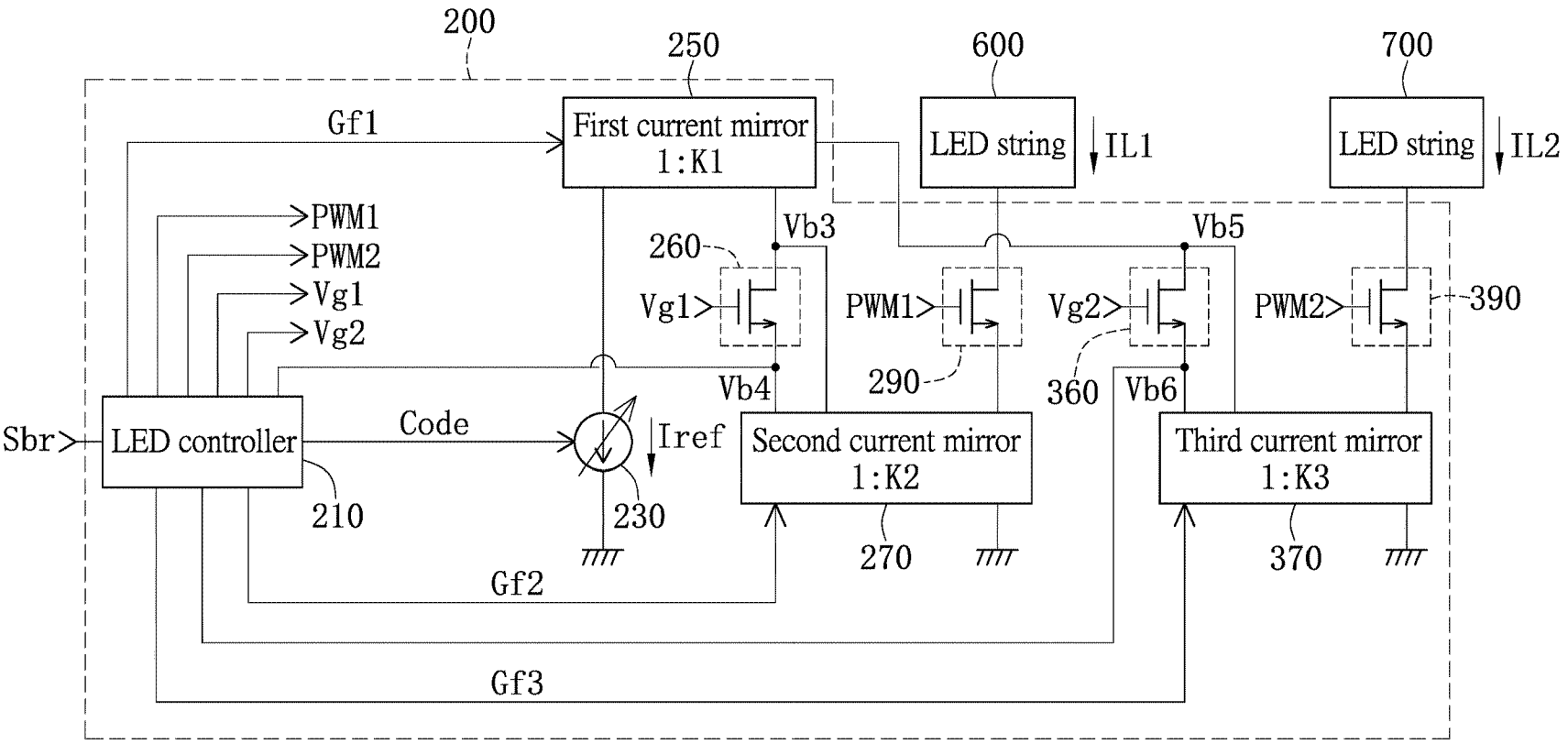
FIG. 7 is a schematic diagram of an LED driver in another embodiment of the present disclosure.

Reference is made to FIG. 7, which is a schematic diagram of an LED driver according to another embodiment of the present disclosure. Compared with the LED driver 100 in the foregoing embodiment, the LED driver 200 of this embodiment is coupled to multiple LED strings which are a first LED string 600 and a second LED string 700; drives the first LED string 600 and the second LED string 700 according to image brightness information Sbr, to reduce the loss of an LED current IL1 flowing through the first LED string 600 and the loss of an LED current IL2 flowing through the second LED string 700 in an operating current range. The LED driver 200 can control the LED currents IL1 and IL2 according to different image brightness information Sbr, to control the brightness of the first LED string 600 and the second LED string 700. The LED driver 200 includes an LED controller 210, a current source 230, a first current mirror 250, a first transistor 260, a second current mirror 270, a drive transistor 290, a third transistor 360, a third current mirror 370, and a drive transistor 390. The LED controller 210 generates a first parameter Gf1, a second parameter Gf2, a digital signal Code, a first control signal Vg1, a first PWM signal PWM1, a third parameter Gf3, a second control signal Vg2, and a second PWM signal PWM2 according to the image brightness information Sbr, to control the foregoing elements, so as to drive the first LED string 600 and the second LED string 700.

A structural relationship and implementations related to the current source 230, the first current mirror 250, the first transistor 260, the second current mirror 270, and the drive transistor 290 are roughly identical with those related to the current source 130, the first current mirror 150, the first transistor 160, the second current mirror 170, and the drive transistor 190 in the foregoing embodiment, so the details are not described herein again. In addition, a structural relationship and implementations related to the third transistor 360, the third current mirror 370, and the drive transistor 390 are roughly identical with those related to the first transistor 160, the second current mirror 170, and the drive transistor 190 in the foregoing embodiment, so the details are not described herein again.

Therefore, the LED driver 200 can simultaneously control the first LED string 600 and the second LED string 700 (that is, multiple LED strings) according to the image brightness information Sbr, to adaptively reduce the loss of the LED currents IL1 and IL2 during operation over the operating current range.

To sum up, the LED driver with brightness control and the driving method thereof provided by the embodiments of the present disclosure adjust an LED current flowing through an LED string according to the brightness to be presented (related to image brightness information) and a relationship between a first rate of a first current mirror, a second rate of a second current mirror, and a third rate for adjusting a reference current (the relationship indicates that a product obtained by multiplying the first rate, the second rate, and the third rate together is a fixed value). Therefore, when an LED current gradually increases from a small current to a large current in an operating current range, the first rate gradually decreases while the second rate gradually increases, to adaptively reduce the loss of the LED current during operation over the operating current range. Therefore, the LED driver and the driving method thereof in the present disclosure do not require that the operator adjusts the variation of the LED current in different operating current ranges in advance, thereby reducing the test time and cost and avoiding the operator from deciding a wrong adjustment amount.

The above merely describes the embodiments of the present disclosure, and is not intended to limit the scope of present disclosure.

What is claimed is:

1. A light-emitting diode (LED) driver with brightness control, used to reduce the loss of an LED current flowing through an LED string in an operating current range, and comprising:

a first current mirror, coupled to a current source, and generating a first current according to a reference current generated by the current source, wherein the first current is a reference current multiplied by a first rate;

a second current mirror, coupled to the first current mirror, coupled to the LED string via a drive transistor, and generating the LED current flowing through the LED string according to the first current, wherein the LED current is the first current multiplied by a second rate; and an LED controller, coupled to the current source, the first current mirror, and the second current mirror; receiving image brightness information; generating a first parameter, a second parameter, a digital signal, and a pulse-width modulation (PWM) signal according to the image brightness information; and driving the LED string according to the PWM signal;

wherein the first current mirror adjusts the first rate according to the first parameter, the second current mirror adjusts the second rate according to the second parameter, and the LED controller adjusts the reference current according to the digital signal multiplied by a third rate, wherein a product obtained by multiplying the first rate, the second rate, and the third rate together is a fixed value.

2. The LED driver with brightness control of claim 1, wherein the first current mirror raises the first rate according to the first parameter.

3. The LED driver with brightness control of claim 1, wherein the second current mirror reduces the second rate according to the second parameter.

4. The LED driver with brightness control of claim 1, wherein the image brightness information is divided into several numeric intervals, the LED controller decreases the second rate and increases the first rate sequentially according to the magnitude of numeric values in these numeric intervals, and the numeric values in these numeric intervals are in direct proportion to the values of the LED current.

5. The LED driver with brightness control of claim 1, wherein the LED controller has a gain adjuster, and the gain adjuster receives and adjusts the digital signal to obtain the digital signal multiplied by the third rate.

6. The LED driver with brightness control of claim 1, further comprising a first transistor switch, coupled between the first current mirror, the second current mirror, and the LED controller, wherein the LED controller generates a control signal according to the image brightness information, drives the LED string according to the PWM signal and the control signal, and controls a drain voltage of the second current mirror according to the control signal.

7. The LED driver with brightness control of claim 6, wherein when the LED current gradually increases to exceed a current threshold, the control signal drives the first transistor, to gradually increase the drain voltage of the second current mirror.

8. The LED driver with brightness control of claim 1, wherein the LED controller turns on/off the drive transistor according to the PWM signal, so as to drive the LED string.

9. A light-emitting diode (LED) driving method with brightness control, applicable to an LED driver, the LED driver comprising a first current mirror and a second current mirror, the first current mirror being coupled to a current source and the second current mirror, and the second current mirror being coupled to an LED string, to reduce the loss of an LED current flowing through the LED string in an operating current range, wherein the LED driving method comprises:

step (A): receiving image brightness information, and generating a first parameter, a second parameter, a digital signal, and a pulse-width modulation (PWM) signal according to the image brightness information;

step (B): adjusting a first rate of the first current mirror according to the first parameter, adjusting a second rate of the second current mirror according to the second parameter, and adjusting a reference current generated by the current source according to the digital signal multiplied by a third rate, wherein the second parameter is equal to the first parameter multiplied by the third rate;

step (C): adjusting the reference current according to the first rate to generate a first current from the first current mirror to the second current mirror, and adjusting the first current according to the second rate to generate an LED current flowing through the LED string, wherein the first current is the reference current multiplied by the first rate, and the LED current is the first current multiplied by the second rate; and step (D): driving the LED string according to the PWM signal.

10. The LED driving method with brightness control of claim 9, wherein in step (B), the first rate is increased according to the first parameter, and the second rate is decreased according to the second parameter.

11. The LED driving method with brightness control of claim 9, wherein the image brightness information is divided into several numeric intervals, and in step (A), the second rate is decreased and the first rate is increased sequentially according to the magnitude of numeric values in these numeric intervals, and the numeric values in these numeric intervals are in direct proportion to the values of the LED current.

* * * * *